US005796082A

United States Patent [19]

Kim

[11] Patent Number: 5,796,082

[45] Date of Patent: Aug. 18, 1998

[54] MICROWAVE OVEN HAVING PARTITIONS IN COOKING CHAMBER FOR CARRYING ROTARY TRAYS

[75] Inventor: Je Myung Kim, Suwon, Rep. of Korea

[73] Assignee: Samsung Electronics Co., Ltd., Suwon, Rep. of Korea

[21] Appl. No.: 726,655

[22] Filed: Oct. 7, 1996

[30] Foreign Application Priority Data

Oct. 26, 1995 [KR] Rep. of Korea ..... 1995 30362

[51] Int. Cl.[6] ..... H05B 6/78

[52] U.S. Cl. ..... 219/752; 219/754; 219/762; 219/763; 219/392; 126/338; 126/339; 99/443 R

[58] Field of Search ..... 219/752, 753, 219/754, 755, 762, 763, 385–392; 126/338, 339, 332, 337 R, 337 A; 99/443 R, DIG. 14

[56] References Cited

U.S. PATENT DOCUMENTS

| | | | |
|---|---|---|---|
| 3,428,772 | 2/1969 | Wallenfels | 219/754 |
| 3,745,291 | 7/1973 | Peterson et al. | 219/754 |
| 4,121,078 | 10/1978 | Takano et al. | 219/754 |
| 4,337,384 | 6/1982 | Tanaka et al. | 219/754 |
| 4,691,088 | 9/1987 | Eke | 219/754 |
| 5,136,933 | 8/1992 | Derakhshan | 99/443 R |
| 5,233,844 | 8/1993 | Knippscheer et al. | 62/440 |
| 5,534,679 | 7/1996 | Beaver, II et al. | 219/388 |

FOREIGN PATENT DOCUMENTS

| | | | |
|---|---|---|---|
| 2 507 060 | 12/1982 | France | 219/753 |
| 3-213910 | 9/1991 | Japan | 219/763 |

*Primary Examiner*—Philip H. Leung

*Attorney, Agent, or Firm*—Burns, Doane, Swecker & Mathis, L.L.P.

[57] ABSTRACT

A microwave oven includes a cooking chamber in which a plurality of removable horizontal partition plates are mounted to divide the cooking chamber into vertically adjacent compartments. A tray is rotatably mounted on each partition plate. A drive shaft carries vertically spaced drive elements, such as friction wheels or gears, which are engageable with respective trays. An electric motor drives the drive shaft to rotate the trays. The trays become disengaged from the drive elements in response to being removed from the cooking chamber. An additional driven tray is mounted on a floor of the cooking chamber.

7 Claims, 8 Drawing Sheets

MICROWAVE OVEN HAVING PARTITIONS IN COOKING CHAMBER FOR CARRYING ROTARY TRAYS

FIELD OF THE INVENTION

The present invention relates to a microwave oven with an improved cooking chamber structure.

BACKGROUND OF THE INVENTION

Microwave ovens are one of the most useful kitchen appliances, and much research and development have been devoted to the fabrication of microwave ovens with good performance and energy-saving design.

Common-type microwave ovens have a single cooking chamber with one space in it, and the cooking chamber is designed big enough to contain the maximum amount of food that can be cooked in it at one time.

Thus, even in the case of cooking a small amount of food, high-frequency microwaves are unnecessarily emitted to the entire space of the cooking chamber, which results in energy dissipation. Particularly, when different kinds of food are cooked with a conventional microwave oven, the frequency in use of the microwave oven is inevitably increased according to the number of foodstuffs to be cooked.

Accordingly, if the cooking chamber's extra space that is not necessary for cooking a small amount of food can be reduced, the consumption of microwave energy can be decreased in proportion to the extra space which is reduced. Further, in the case that a cooking chamber is divided into a plurality of cooking compartments, more than one kind of foodstuffs can be simultaneously cooked in the separate compartments of the cooking chamber.

When it comes to dividing the cooking chamber into several spaces, this can be easily applied to a showering-type microwave oven in which a stirrer serves to disperse high-frequency microwaves. The division of the cooking chamber however, is not adequate to a conventional turntable-type microwave oven (shown in FIG. 6) with a tray 2 on which foodstuffs are placed for cooking, which rotates on its axis to disperse microwaves.

In other words, the showering-type microwave oven has a partition provided at a predetermined part of its cooking chamber to radiate high-frequency microwaves in different directions inside the cooking chamber. On the contrary, the turntable-type microwave oven requires a secondary device for turning the tray in its cooking chamber in order to allow the dispersion of microwaves relative to the food.

SUMMARY OF THE INVENTION

Accordingly, it is an object of the present invention to provide a microwave oven with a cooking chamber whose interior can be divided into a plurality of cooking compartments corresponding to the number of foodstuffs to be cooked at the same time.

It is another object of the present invention to provide a microwave oven in which high-frequency microwaves used for fast cooking are dispersed by the rotation of a tray provided to each one of separated cooking compartments.

In order to achieve the above objects and advantages in accordance with the purpose of the present invention, as embodied and broadly described, a microwave oven includes a main body; a cooking chamber provided in the main body; a first tray placed on the bottom of the main body to be rotated by an electric motor; and a plurality of partitions detachably mounted in the cooking chamber to divide this chamber into a plurality of cooking compartments.

The inventive microwave oven also includes second trays rotatably placed on the respective partitions; and a plurality of driving members driven by another electric motor in order to make the second trays rotate.

The respective driving members come in rolling contact with each one of said second trays or the second tray is meshed with the driving member. The driving member is formed of a rubber roller to come into contact with an outer circumference of the second tray, and a rubber band is provided on the outer circumference of the second tray.

The driving member is formed of a spur gear, and comes into contact with the outer circumference of the second tray. A ball is interposed between each partition and each second tray.

Besides, a pair of upper and lower tracks may be respectively formed on the bottom of the second tray and the upper surface of the partition. A plurality of rotating rollers are disposed on each one of the partitions. A plurality of the partitions are horizontally provided in the cooking chamber, maintaining spacing from each other.

The inventive microwave oven further includes a plurality of guide grooves formed on both inner sidewalls of the cooking chamber into which each partition is slidably inserted. Instead of the guide grooves, a plurality of guide projections may be formed on both inner sidewalls of the cooking chamber over which each partition is slidably mounted, in parallel with the bottom of the cooking chamber.

DESCRIPTION OF THE PREFERRED EMBODIMENTS

Preferred embodiments of the present invention will now be discussed in detail with reference to the accompanying drawings.

Figure 1:
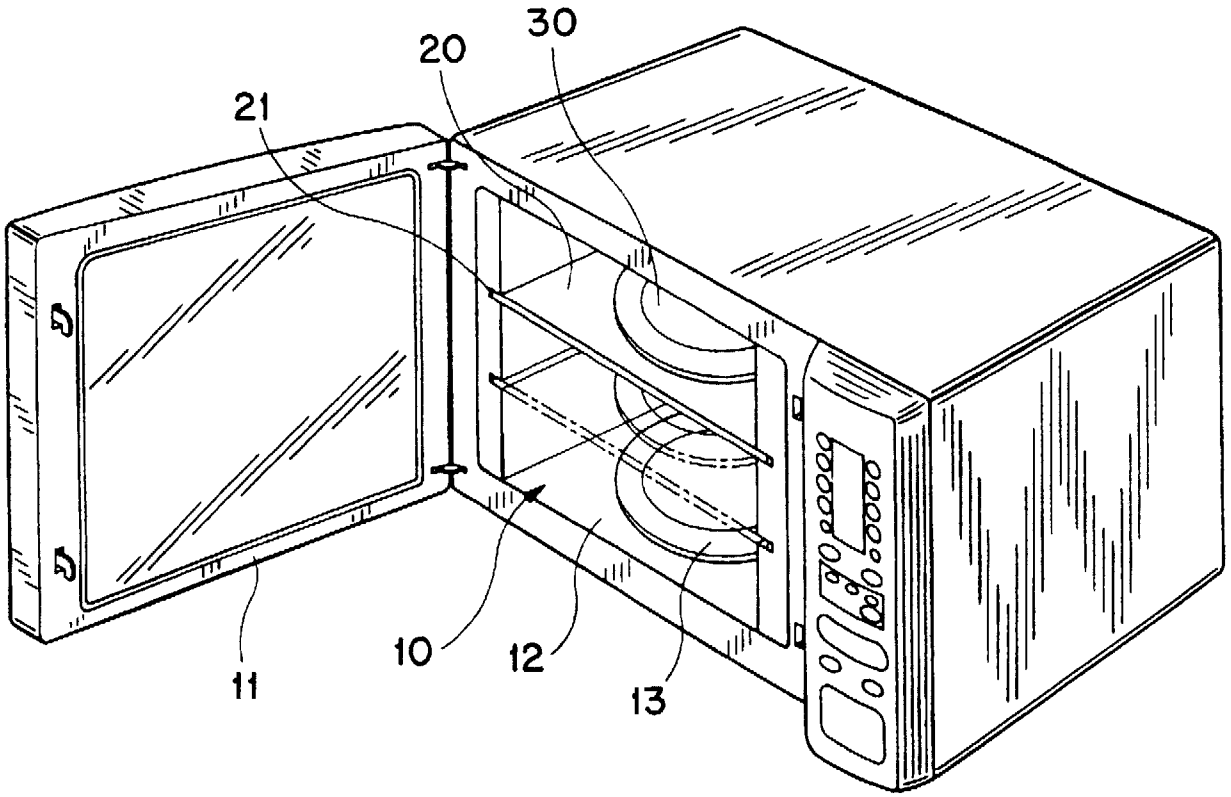
FIG. 1 is a perspective view of a microwave oven with a cooking chamber whose interior is varied in shape according to the present invention.

Attention is first invited to FIG. 1 which illustrates a perspective view of a microwave oven with a cooking chamber whose interior is varied in shape according to the present invention.

A cooking chamber 10 which is opened and closed by a door 11 includes at least one partition or shelf 20 which may horizontally divide the interior of the cooking chamber 10 into at most three cooking compartments to be in parallel to a bottom surface or floor 12 of the cooking chamber 10. The partition 20 is held by supporting means formed on both inner sidewalls of the cooking chamber 10. The cooking compartments of the cooking chamber 10 may be varied in size with the position of the partition 20. The supporting means are formed on several spots of the inner sidewalls in order to enlarge the range of choice when it comes to mounting the partition 20.

The supporting means are formed on the left and right inner sidewalls to be oppositely disposed respective to each other, and it is preferable that they are guide grooves 21 into which both sides of the partition 20 can be slidably horizontally inserted, and it is possible to form projections or rails as supporting means so as to put the partition 20 over the projections or rails.

In the case that the partition 20 is a common-type plate, it is adequate to a showering-type microwave oven in which high-frequency microwaves are dispersed by the rotation of a stirrer.

Figure 2:
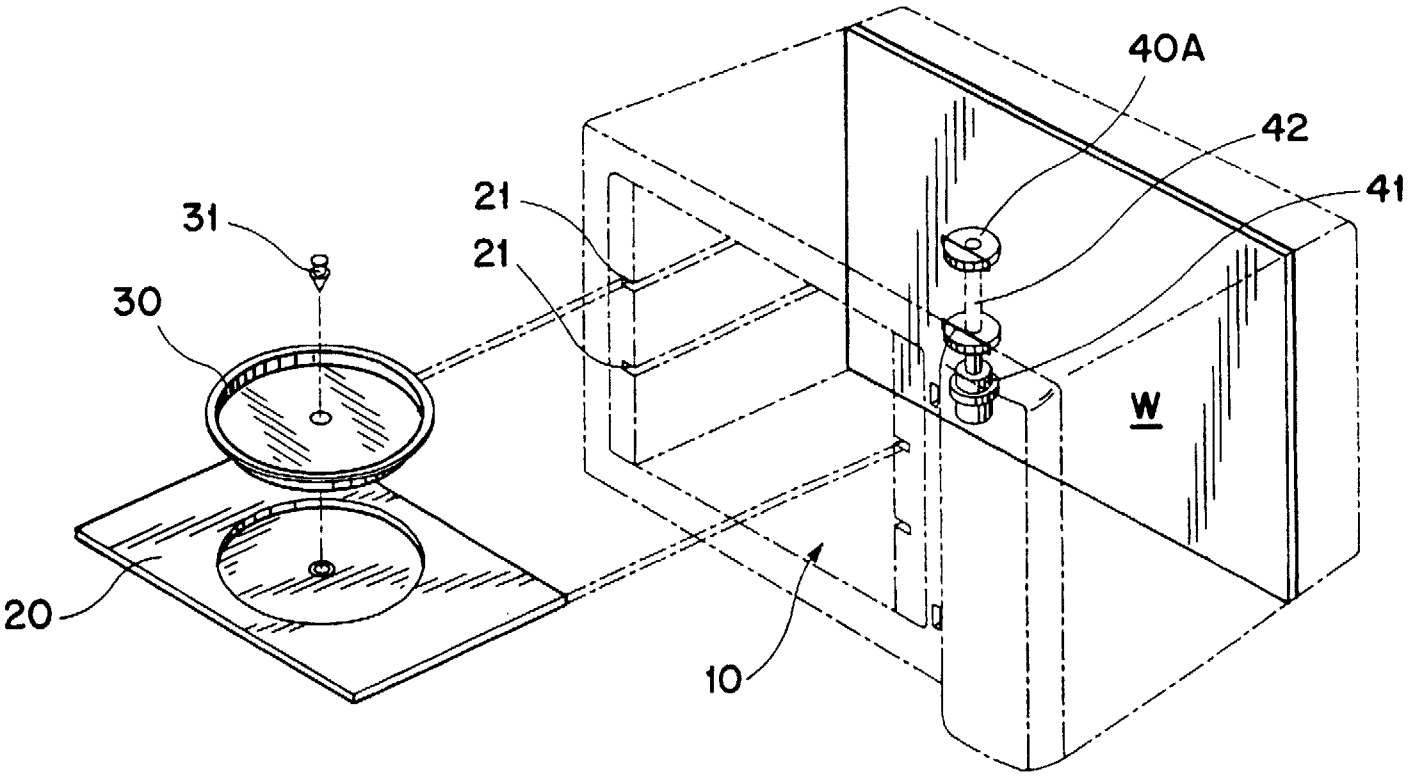
FIG. 2 is a perspective exploded view of a microwave oven in which a partition and a tray of FIG. 1 are being disassembled from the chamber.
Figure 3:
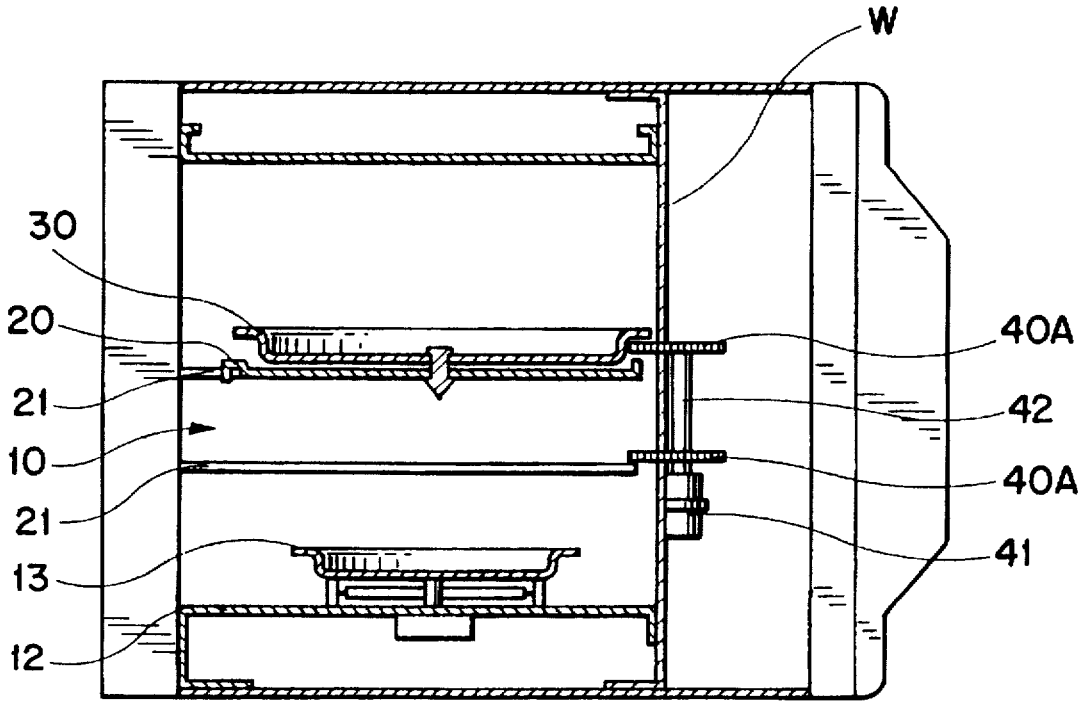
FIG. 3 is a vertical cross-sectional view of the microwave oven of FIG. 1 in accordance with the present invention.

FIG. 2 is an exploded perspective view of a microwave oven having a partition and a tray.

As shown in FIG. 2, the disk-shaped tray 30 is rotatably placed on the upper surface of the partition 20, and a spindle 31 is formed to pass through the center of the tray 30 and acts as the center of rotation of the tray 30, while serving to settle the tray.

Figure 4A:
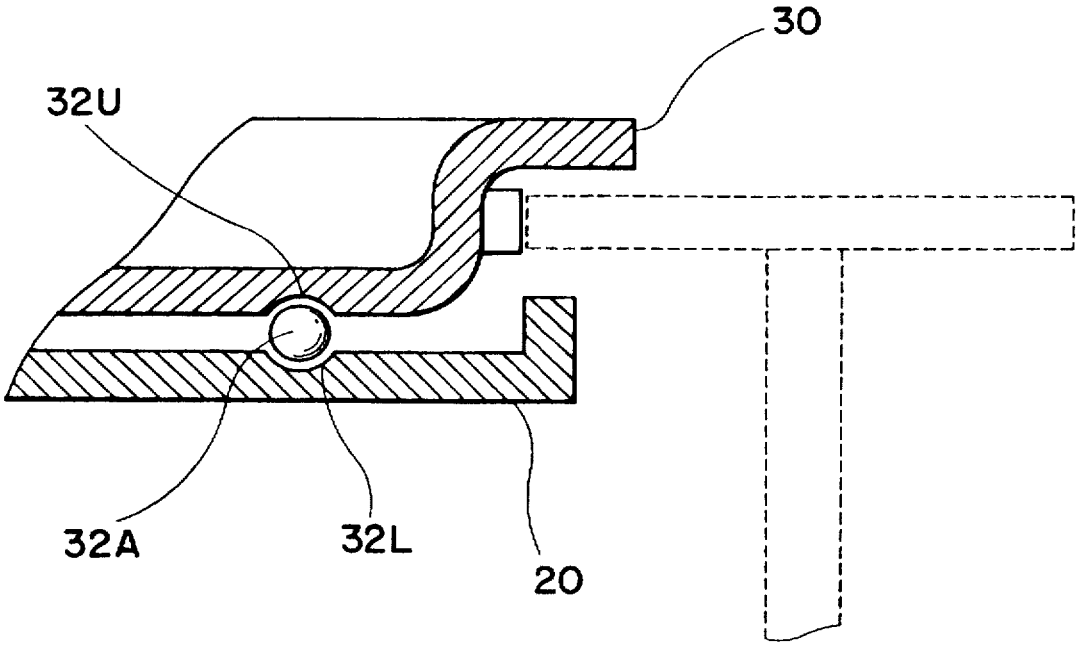
FIG. 4A is an enlarged sectional view of a portion of a rotation supporting member of the tray in accordance with a first preferred embodiment thereof.

Ball bearing 32A (only one shown) are is interposed between the tray 30 and the partition 20, as shown in FIG. 4A. Driving members 40A and 40B are provided on the rear wall W of the cooking chamber 10 in order to rotate the tray 30, which is depicted in FIGS. 5A and 5B.

A track 32U or an upper concavity is formed in the bottom of the tray 30, and a track 32L, a lower concavity, is formed in the upper surface of the partition 20 in order to prevent the ball bearing 32A from coming out of the space between the tray 30 and the partition 20 when the tray 30 rotates around the spindle 31.

Figure 4B:
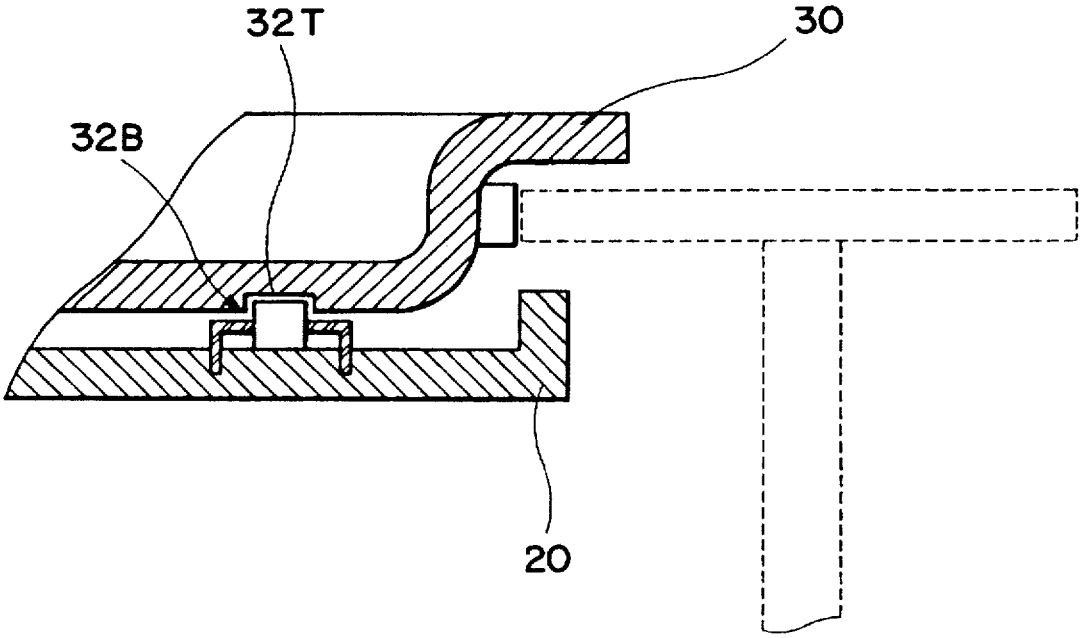
FIG. 4B is an enlarged sectional view of a portion of a rotation supporting member of the tray in accordance with a second preferred embodiment thereof.

Turning to FIG. 4B depicting a rotation supporting member of the tray in accordance with another embodiment of the present invention, rollers 32B (only one shown) are rotatably disposed on the upper surface of the partition 20 in the form of and a track 23T, an upper concavity, is formed on the bottom of the tray 30 to correspond to the roller 32B.

Figure 5A:
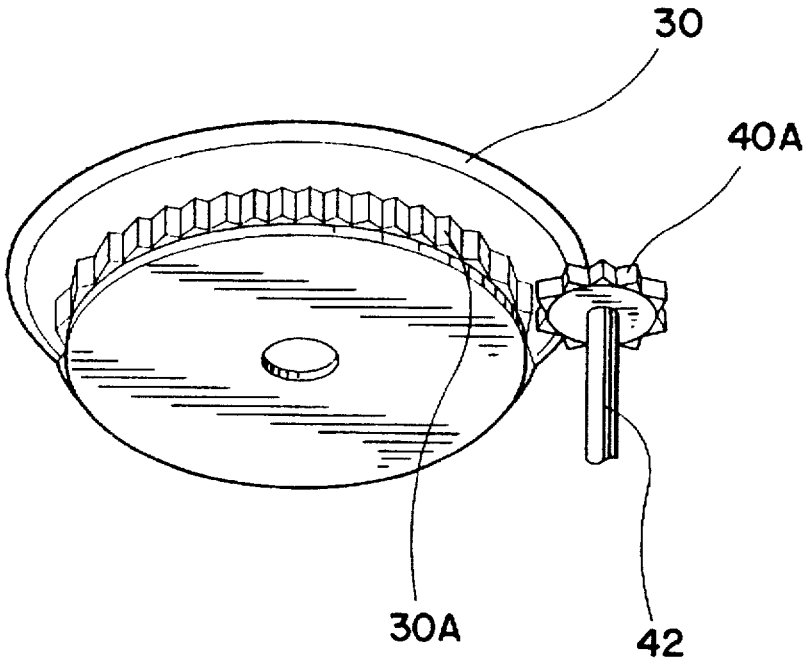
FIG. 5A is an enlarged perspective view of a driving member for turning the tray in accordance with a first preferred embodiment thereof.
Figure 5B:
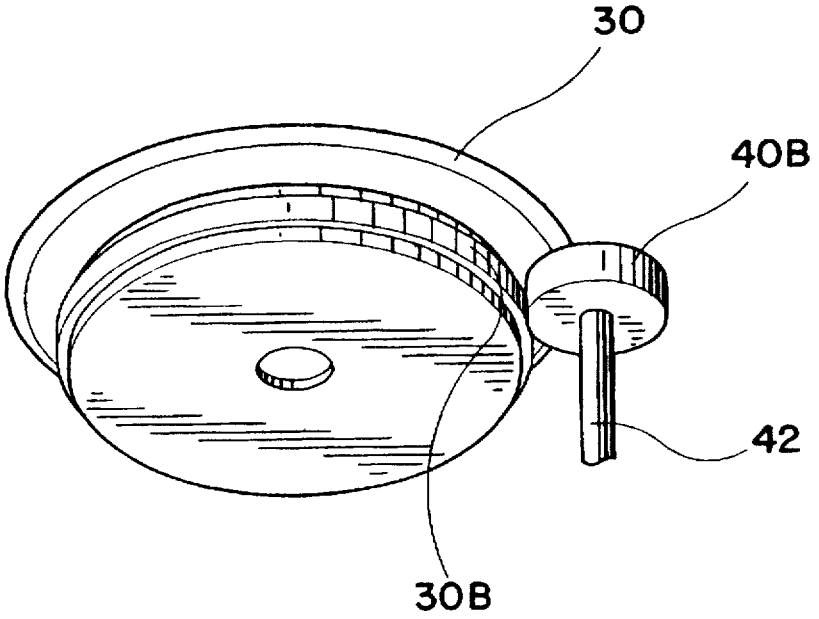
FIG. 5B is an enlarged perspective view of a driving member for turning the tray in accordance with a second preferred embodiment thereof.
Figure 6:
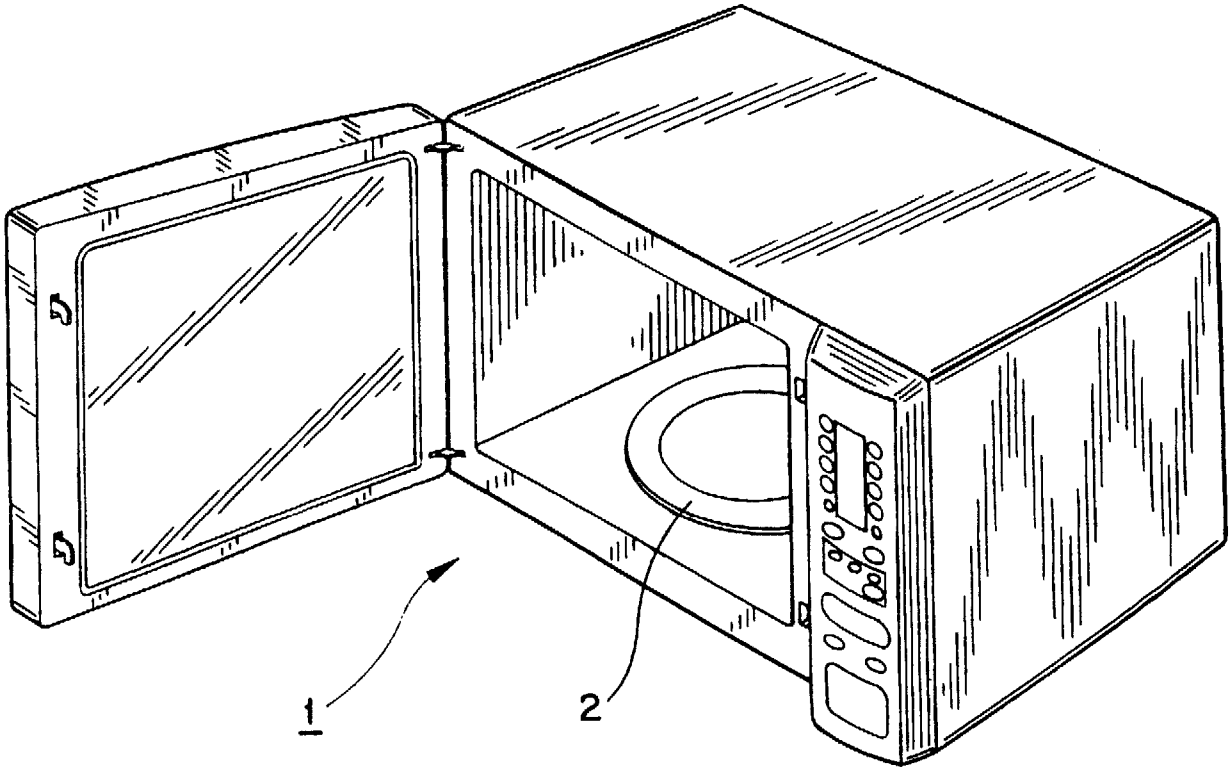
FIG. 6 (PRIOR ART)
FIG. 6 is a perspective view of a microwave oven with a cooking chamber which is designed according to a conventional art.

The driving member 40 of FIG. 5A consists of a spur gear 40A connected with a driving shaft 42. The spring gear 40A meshes with teeth 30A formed on the tray 30 so that the tray 30 can rotate as the spur gear 40A is turned by a motor 41.

In the meantime, an alternative driving member 40 of FIG. 5B is formed of a rubber roller 40B, and a rubber band 30B is provided on the outer circumference of the tray 30 to come in frictional contact with the rubber roller's outer circumference.

The respective driving members 40A and 40B are spaced along the driving shaft 42. 40A and 40B is positioned to meet the side wall of the tray 30 turning on the partition 20 inserted into the guide grooves or put over the projections in such a manner that wherever the partition 20 having the tray 30 in response to inward sliding of the partitions is mounted, at least one of the two come in contact with the outer circumference of respective tray 30 so as to transmit rotating force thereto to.

Accordingly, when no partitions 20 are being used in the cooking chamber 10 of the present invention, foodstuffs to be cooked are put on a lower tray 13 which is rotatably placed on the bottom 12 of the cooking chamber 10 and is rotated by a motor 43.

In case that the amount of food is small, a partition 20 is installed in the cooking chamber 10 to divide its interior into relatively small compartments prior to cooking, and to cook the food in one of the cooking compartments, which provides the efficient use of the cooking space of the microwave oven, and enhances the efficiency of microwave dispersion.

Besides, the installation of the partition 20 within the cooking chamber 10, forms two cooking compartments for the inventive microwave oven, and therefore, it is possible to cook different kinds of foodstuffs such as meat, fish, vegetables, etc. at the same time by the use of the inventive microwave oven. Accordingly, the inventive microwave oven ensures a decrease in the time required for cooking several dishes.

The cooking chamber 10 of the present invention includes a plurality of the supporting means for stably holding the partition 20 on the left and right inner sidewalls, and the size of the cooking space inside the cooking chamber 10 may be varied according to the amount of foodstuffs to be cooked.

As discussed above, the microwave oven of the present invention has an advantageous aspect of cooking function by providing the cooking chamber that may be divided into a plurality of cooking compartments or adjustable to the amount of food to be cooked. Thus, the present invention allows a plurality of dishes to be cooked in the separated cooking compartments at the same time so that the time required for cooking can be reduced. In other words, the inventive microwave oven is of time and energy-saving construction.

What is claimed is:

1. A microwave oven comprising:

a body forming a cooking chamber;

a microwave generator for supplying high frequency waves to the cooking chamber;

a plurality of trays mounted in the cooking chamber in vertically superimposed relationship, each tray being rotatable about a vertical axis, one of the trays mounted on a horizontal partition dividing the cooking chamber into respective compartments containing respective ones of the trays;

a plurality of motors mounted in the body and operably connected to respective ones of the trays for providing separate control of the trays.

2. The microwave oven according to claim 1 wherein the cooking chamber includes a floor, a first of the trays being rotatably mounted on the floor and rotated by a first of the motors; a horizontal partition mounted in the cooking chamber above the floor, a second of the trays being rotatably mounted on the partition and rotated by a second of the motors.

3. The microwave oven according to claim 2, further comprising a drive transmitting mechanism connected to the second motor and extending into the cooking chamber, the drive transmitting mechanism including a drive member disposed in the cooking chamber; the partition being slidable horizontally inwardly into the cooking chamber and slidable horizontally outwardly from the cooking chamber; the second tray being positioned to make direct contact with the drive member in response to the horizontal inward movement of the partition and to be released from contact with the drive member in response to the horizontal outward movement of the partition.

4. The microwave oven according to claim 3 wherein the partition constitutes a first partition, and the drive member constitutes a first drive element, the oven further including a second horizontal partition extending over and spaced vertically from the first partition, a third of the trays being rotatably mounted on the second partition; the drive transmitting mechanism including a second drive member disposed in the cooking chamber; the second partition being horizontally slidable relative to the first partition horizontally inwardly into the cooking chamber and slidable horizontally outwardly from the cooking chamber; the third tray positioned to make direct contact with the second drive member in response to the horizontal inward sliding of the second partition, and to be released from contact with the second drive member in response to the horizontal outward sliding of the second partition.

5. The microwave oven according to claim 3 wherein the contact between the second tray and the drive member is frictional contact.

6. The microwave oven according to claim 2 wherein each of the floor and partition includes an upwardly open annular groove in which ball bearings are mounted for rolling movement, the first and second trays seated on the ball bearings of the floor and partition, respectively.

7. A microwave oven comprising:

a body forming a cooking chamber;

a microwave generator for supplying high frequency waves to the cooking chamber;

a horizontal shelf mounted in the cooking chamber; a tray mounted on the shelf for rotation relative to the shelf about a vertical axis;

a motor mounted to the housing;

a drive transmitting mechanism connected to the motor and extending into the cooking chamber, the drive transmitting mechanism including a drive member disposed in the cooking chamber;

the shelf being slidable horizontally inwardly into the cooking chamber and horizontally outwardly from the cooking chamber, and the tray being positioned to make direct contact with the drive member in response to the horizontal inward movement of the shelf, and to be released from contact with the drive member in response to the horizontal outward movement of the shelf.

* * * * *